US009027640B2

(12) United States Patent
Buyers et al.

(10) Patent No.: US 9,027,640 B2
(45) **Date of Patent: *May 12, 2015**

(54) METHOD FOR SIGNALLING A DOWNHOLE DEVICE IN A WELL

(71) Applicant: Omega Completion Technology Ltd., Dyce, Aberdeen (GB)

(72) Inventors: Mark Buyers, Aberdeen (GB); David Forsyth, Aberdeen (GB)

(73) Assignee: Omega Completion Technology Ltd., Dyce (GB)

( * ) Notice: Subject to any disclaimer, the term of this patent is extended or adjusted under 35 U.S.C. 154(b) by 246 days.

This patent is subject to a terminal disclaimer.

(21) Appl. No.: 13/848,571

(22) Filed: Mar. 21, 2013

(65) Prior Publication Data

US 2013/0213644 A1 Aug. 22, 2013

Related U.S. Application Data

(60) Continuation-in-part of application No. 12/637,566, filed on Dec. 14, 2009, now Pat. No. 8,544,542, which is a division of application No. 11/569,311, filed as application No. PCT/GB2005/001793 on May 11, 2005, now Pat. No. 7,673,680.

(30) Foreign Application Priority Data

May 19, 2004 (GB) ..... 0411121.7

(51) Int. Cl.
*E21B 47/06* (2012.01)
*E21B 41/00* (2006.01)
(Continued)

(52) U.S. Cl.
CPC ..... *E21B 41/0092* (2013.01); *E21B 43/12* (2013.01); *E21B 47/06* (2013.01); *E21B 47/065* (2013.01); *E21B 47/1025* (2013.01)

(58) Field of Classification Search
CPC ..... E21B 47/065; E21B 41/092
See application file for complete search history.

(56) References Cited

U.S. PATENT DOCUMENTS 3,577,782 A 5/1971 Aitken
3,800,277 A 3/1974 Patton et al.
(Continued)

FOREIGN PATENT DOCUMENTS

EP 0237662 9/1987
EP 0566382 10/1993
(Continued)

*Primary Examiner* — David Andrews
(74) *Attorney, Agent, or Firm* — Kirton McConkie; Evan R. Witt

(57) ABSTRACT

A method and apparatus for controlling the operation of a well involves locating a pressure monitoring device downhole and arranging it to be operative: to monitor a characteristic pressure profile of a well during a certain time span controlled by a downhole clock associated with the device; to monitor the temperature downhole in the region of the clock; to calibrate a time reading of the downhole clock with reference to the monitored temperature to correct for drift between the clock time and real time resulting from the downhole elevated temperature; and to respond and generate a triggering output when a significant deviation to the pressure profile is introduced into the well as a control signal to the monitoring device, by comparing two separate pressure profiles within the time span, the device only generating the triggering output when the same pressure profile is monitored twice within the time span.

19 Claims, 7 Drawing Sheets

(51) Int. Cl.
*E21B 43/12* (2006.01)
*E21B 47/10* (2012.01)

(56) References Cited

U.S. PATENT DOCUMENTS

| | | | |
|---|---|---|---|
| 4,796,699 | A | 1/1989 | Upchurch |
| 4,856,595 | A | 8/1989 | Upchurch |
| 4,915,168 | A | 4/1990 | Upchurch |
| 5,050,675 | A | 9/1991 | Upchurch |
| 5,273,113 | A | 12/1993 | Schultz |
| 5,355,960 | A | 10/1994 | Schultz et al. |
| 5,412,568 | A | 5/1995 | Schultz |
| 5,490,564 | A | 2/1996 | Schultz et al. |
| 5,691,712 | A | 11/1997 | Meek et al. |
| 5,887,657 | A | 3/1999 | Bussear et al. |
| 6,021,095 | A | 2/2000 | Tubel et al. |
| 6,125,930 | A | 10/2000 | Moyes |
| 6,167,965 | B1 | 1/2001 | Bearden et al. |
| 6,776,240 | B2 | 8/2004 | Kenison et al. |
| 6,957,699 | B2 | 10/2005 | Feluch et al. |
| 7,055,598 | B2 | 6/2006 | Ross et al. |
| 7,171,309 | B2 | 1/2007 | Goodman |
| 8,544,542 | B2 * | 10/2013 | Buyers et al. ..... 166/250.07 |
| 2002/0043369 | A1 | 4/2002 | Vinegar et al. |
| 2002/0074118 | A1 | 6/2002 | Fisher |
| 2002/0195247 | A1 | 12/2002 | Ciglenec et al. |
| 2004/0006430 | A1 * | 1/2004 | Harmon et al. ..... 702/14 |
| 2004/0035577 | A1 | 2/2004 | Ramakrishnan et al. |
| 2004/0065477 | A1 | 4/2004 | Paulk et al. |

FOREIGN PATENT DOCUMENTS

| | | |
|---|---|---|
| GB | 1547816 | 6/1979 |
| GB | 2280013 | 1/1995 |
| GB | 2314863 | 1/1998 |
| GB | 2339226 | 1/2000 |
| GB | 2411677 | 9/2005 |
| GB | 2431943 | 5/2007 |
| WO | 9011429 | 10/1990 |
| WO | 90/13731 | 11/1990 |
| WO | 9705362 | 2/1997 |

* cited by examiner

METHOD FOR SIGNALLING A DOWNHOLE DEVICE IN A WELL

CROSS-REFERENCE TO RELATED APPLICATION

This application is a continuation-in-part of U.S. application Ser. No. 12/637,566, filed Dec. 14, 2009, which is a divisional application of U.S. application Ser. No. 11/569,311, filed Nov. 17, 2006, which is the National Stage of International Application No. PCT/GB2005/01793, filed May 11, 2005, which applications are incorporated by reference.

BACKGROUND

In the oil and gas industries, petrochemicals and hydrocarbon gases are extracted from deep in the earth through pressure bearing tubulars or "tubing". The tubing forms a conduit from the rock where the petrochemicals reside to the surface where it is terminated at the Wellhead or Christmas Tree. The wellhead is equipped with a number of valves to control and contain the pressure which is present in the tubing.

The oil or gas flows from source rock which may exist in a layer of just a few feet to many hundreds of feet. The quality and productivity of the rock may vary over distance and water or other undesirable elements may exist at certain points. Usually it is best practice to produce over the entire oil bearing interval and for any water to be produced along with the oil. Towards the latter stages of a well's life, the water production will generally increase at the expense of oil production. Production optimisation will depend on minimising the water production which will maximise the oil production.

Production may also be lost to "thief" zones. Thief zones are areas of rock penetrated by the wellbore which have less pressure than others. Crossflow can occur from a good high pressure zone to a poor low pressure zone (see FIG. 1). Obviously, this is inefficient. Production optimisation will depend on isolating the thief zone until such time as the good high pressure zone has depleted to the extent that the pressure is the same or lower than the thief zone. Once the isolation has been removed, both zones may be allowed to flow to surface.

The production may initially be optimised by "shutting off" thief zones or water producing zones. Firstly, these zones must be identified and targeted. Instruments lowered into the wellbore on a wireline cable allow pressure, temperature, flow measurement and flow composition readings to be taken. Following analysis, a second intervention into the well may be conducted to mechanically close off the undesirable zone(s). A variety of equipment is available for this but most will dictate permanently closing off a part of the wellbore which action may be undesirable in later years.

A technology whereby the zones of a well may be individually opened or closed to help optimise the production from that well is called "smart well" technology. Differing zones are mechanically separated and isolated by packer assemblies (see FIG. 2). Flow from the zones is received through a valve which may allow on/off or incremental flow. Most of these valves feature a sleeve which uncovers flow ports in the outside diameter of the tool. Many of these valves may be installed in a well with surface control being provided by means of electric cables, hydraulic control lines or other means. Most smart well systems require a physical link from the bottom of the well or the valve apparatus to surface in order to provide hydraulic contact, electrical contact or both. Not only is this expensive, it becomes a source of unreliability. Failure of one part of this type of system may compromise all of the system. Obviously, the complexity (and unreliability) of the installation increases proportionally with the number of valves and the increase in control lines and/or electric lines, splices and connections.

Equipment which uses this type of physical link must be installed when the well is new. It is not capable of retrofitting into an existing well.

The ability to repeatedly open and close various zones from surface allows true optimisation without the need to intervene in the well for data collection or for installation of shut off equipment. Also, isolated zones may easily and quickly be re-opened for evaluation and potential production later in the life of the well or simply just for re-evaluation purposes.

Many wells are not suited to intervention techniques due to the great cost associated with these operations. These may be subsea wells where no facilities exist to support the intervention, high pressure wells where safety is a prime consideration or remote wells where also, no facilities exist.

Recent innovations in the electro mechanical and acoustic fields have sought to mitigate the disadvantages of the physical link to surface and associated unreliability. These devices may offer a greater degree of flexibility and possibly higher reliability in the future. These technologies are as yet unproven and may have undesirable issues of their own such as limited range, high power consumption and lack of proven operation.

Accordingly, the present applicants sought to provide an alternative means of smart well operation with no boundaries of range and great service life due to low power consumption. This resulted in the apparatus and method which was the subject of International Application No. PCT/GB2005/01793.

Whilst the invention which was the subject of the above identified Application addressed a significant problem with the prior methods and apparatus, discussed in detail above, there is a desire to improve upon the disclosed method and apparatus. In particular, the applicants have recognised that the elevated temperatures which are experienced downhole can impact upon performance of the apparatus.

In more detail, the disclosed method and apparatus involves the monitoring of a characteristic pressure profile of a well during a certain time span, and selective triggering of an actuator to perform any required operation of the well. Such might involve the opening or closing of a valve downhole, to control fluid flow. Triggering of the actuator occurs when the same pressure profile is monitored twice within the time span, which may be a certain hour of the day on separate days. The apparatus employs a downhole clock, which controls operation of a pressure monitoring device. The pressure monitoring device is arranged to monitor the pressure profile during the desired time span according to the time outputted by the clock. This requires correlation between the output of the downhole clock and a real-time clock at surface, so that the control signal is sent at the appropriate time.

The elevated temperatures experienced downhole can, however, cause 'drift' between the time measured by the clock downhole and real time. For example, the clock may typically experience temperatures downhole of around 150° C. In a modern electronic clock employing a timing crystal, this can lead to a drift of around 1 minute per day relative to real time. The clock thus effectively runs around one minute faster per day when exposed to such temperatures. These discrepancies can build up over a period of days, months and years, and could potentially result in a control signal being sent at a time when it is expected that the device would be looking for the signal, but in which the device is actually inoperative. A desired actuation operation would not therefore by carried out. The invention which is the subject of the present application seeks to address this issue.

SUMMARY OF INVENTION

The invention seeks generally to utilise the "pressure fingerprint" which all wells possess, whether they are high pressure wells, injection wells, normally flowing wells, pumped wells or wells which are produced with other secondary recovery techniques such as gas lift. We refer to "pressure fingerprint" as being the pressure characteristics of a particular well which are bestowed as a function of the nature of the fluid in the wellbore, the ratio of oil to gas or other fluids/gasses, the reservoir pressure, the diameter and length of the production tubing and the choke or orifice size used at surface to restrict the well flow for processing purposes. All these factors conspire to provide an individual pressure profile or performance characteristics for a particular well which will differ from most other wells.

The invention will recognise, in a dynamic flowing situation, an event deliberately applied to change the pressure fingerprint in order that recognition of that event be used as the trigger to activate a device positioned in the wellbore or at the bottom of the well.

The pressure signature of a well can be changed in many ways. When a well is shut in, both the bottom hole pressure (BHP) and the surface wellhead pressure (WHP) will increase (see FIG. 3). The increase will initially be rapid but will tail off as stabilisation occurs after some time. The increase witnessed will substantially be the same both downhole and at surface.

The invention may be programmed to measure and record this build up curve or a number of compared curves but in signalling the device, production will be lost and the process equipment may become upset due to large dynamic changes. Accordingly, shutting in a well in order to generate an operating signal or trigger is not attractive. The techniques of pressure measurement downhole with quartz, strain, silicon and sapphire technologies are well known to one versed in the art as are the processing and memory functions also required for operation of the device.

When a well is opened to allow flow, both BHP and WHP will drop a similar amount, rapidly first and then stabilise with time (See FIG. 4). When a well is flowing through a restriction (or choke) at surface of a certain size and the flow is subsequently diverted through another smaller choke, both BHP and WHP will increase as previously described but fractionally compared with shutting off the flow completely (see FIG. 5). A well which is flowing through a one inch choke might typically exhibit a pressure increase of 200 psi (both downhole and at surface) when flow is diverted through a three quarter inch choke. The majority of the 200 psi increase will occur within the first fifteen minutes following the change. This will provide a discrete and recognisable event which may be recorded for comparison with later events.

It is possible that the applied event (choking the well) may be confused with normal operational events of a similar nature. To prevent this, the invention compares events which are being monitored with previously monitored events. One possible configuration is to programme the device such that triggering output will only be allowed when exactly the same event is monitored twice within a certain time span. For example, the device will monitor events (BHP) from a time, say 12 noon, each day for one hour only. If during the one hour listening period, the programmed "event profile" is matched on both days, then triggering output would result. This condition may be satisfied by producing the well on a smaller choke for a short period starting just after 12 noon. Following this the well may be produced back on the normal choke until the next day when the exact same process may be repeated. Comparison of the second event with the first may allow triggering of the device if the required conditions are satisfied. The pressure profile of a choke change has been chosen for this example in that it is sufficiently distinctive as to avoid confusion with other operational constraints.

Additionally, thresholds may be applied to prevent erroneous operation. The thresholds may comprise a plus and minus pressure band allowing for stability checks prior to any other measurement. The slope of the pressure increase (pressure versus time) and extent of the pressure increase may be set within limits to further tune the system to prevent activation from erroneous data.

As battery power is finite for this type of equipment, normally, the equipment would be dormant save for the one hour daily when it must listen for the signal. Additionally, as there will in all probability be more than one device of this nature in a well, the individual devices may be programmed with differing listening times. Selective operation may be achieved by executing the required surface event (choke change) at times corresponding to the pre programmed listening times of the individual devices. For a four device installation, listening periods may be staggered by six hour intervals.

Although the principle mode of operation is one of altering the dynamic properties of a flowing well, situations may occur for safety or other reasons where the well is not flowing but operation of the devices is required. It is well known that pumping fluid or injecting into a well has the effect of increasing the pressure. This action will have the same effect as the previously described choke change in that if correctly timed, it may be recognised by the listening device. Pumping a known volume over a known time beginning at a particular time on two consecutive days may be recognised by the device allowing it to trigger. Similarly in water injection wells where no product is produced from the well but where water is pumped down in order to maintain the pressure in an oil field, alteration of the pump rate or choking of the flow into the well will qualify as a recognisable signal to the device provided that the previously detailed parameters are satisfied.

Occasionally wells demonstrate a condition known as slugging. A slugging well flow alternates between production of mostly oil to production of mostly gas. The pressure profile of these wells is often wave like. As the gas is released, the BHP drops slightly. As the oil slug makes its way up the tubing and more oil enters from below, the BHP increases until the oil is produced at surface and the hydrostatic pressure in the wellbore is reduced. Accordingly, the BHP drops quickly. The cycle then repeats itself. The well head pressure does not track the bottom hole pressure in a slugging well unlike as has previously been described.

Slugging wells may be characterised by constantly changing pressure which demonstrates the need for an initial stability band within the device. Changing choke on a slugging well will in all probability not provide the recognisable signal which the device requires. In this circumstance, the well must be shut in and allowed to stabilise and fluid or gas must be pumped down the well under the same conditions on two consecutive days at the same time each day in order to trigger output from the device.

Some wells are mechanically pumped or are lifted by injecting gas at some depth in the well. A pumped well may provide a recognisable pressure signature simply by switching off the pump at the appropriate time on consecutive days.

Similarly, gas lift wells may have their gas flow interrupted or substantially increased in order to provide recognisable criteria.

In an aspect of the invention, there is provided a method for controlling the operation of a well, the method comprising the steps of:

locating a pressure monitoring device downhole;

arranging the pressure monitoring device so that it is operative:

to monitor a characteristic pressure profile of the well during a certain time span; and to respond and generate a triggering output when a significant deviation to the pressure profile is introduced into the well as a control signal to the monitoring device, by comparing two separate pressure profiles within the time span, the device only generating the triggering output when the same pressure profile is monitored twice within the time span;

arranging an actuator so that it is initiated into operation to control any required operation of the well when the monitoring device responds to the control signal and generates the triggering output;

in which the method comprises the further steps of:

arranging the pressure monitoring device to monitor the characteristic pressure profile during the specified time span controlled by a downhole clock associated with the device;

monitoring the temperature downhole in the region of the clock; and calibrating a time reading of the downhole clock with reference to the monitored temperature, to correct for drift between the clock time and real time resulting from the elevated temperature which the clock is exposed to downhole.

The invention therefore accounts for the drift which occurs due to the elevated temperatures experienced downhole, and may help to ensure that the pressure monitoring device is active and monitoring the pressure during the required time span. In this way, the problem in which a control signal is sent at a time when it is expected that the device will be looking for the signal, but in which the device is actually inoperative, can be avoided.

The method may be for controlling the operation of a flowing or producing well. The pressure monitoring device may be operative to monitor a characteristic pressure profile of the flowing well.

The method may be for controlling the operation of a well which is not flowing or in which fluid is pumped or injected into the well.

The step of calibrating the time reading of the downhole clock may comprise: analysing a time reading output by the clock; assessing the drift with real time which has resulted employing the monitored temperature data; and correcting the time reading by an appropriate amount. The method may therefore involve correcting (or calibrating) the time reading of the clock. The corrected (or calibrated) time reading on the downhole clock may be issued to the pressure monitoring device.

The step of calibrating the time reading of the downhole clock may comprise: analysing a time reading output by the clock; assessing the drift with real time which has resulted employing the monitored temperature data; and issuing a corrected (or calibrated) time reading to the pressure monitoring device. In this scenario, the method may involve correcting (or calibrating) the time reading output by the downhole clock, but without directly correcting the reading on the clock. The corrected (or calibrated) time reading may be issued to the pressure monitoring device.

Correction of the time reading according to either method set out in the preceding paragraphs may occur on an ongoing basis, or at periodic intervals. In either case, but particularly the latter, the method may comprise storing monitored temperature history so that an appropriate calibration can be made.

The step of calibrating the time reading may be performed employing a microprocessor, which may be associated with the pressure monitoring device, a temperature monitoring device (for monitoring the temperature) and the clock. Data may be stored in a memory associated with the microprocessor, which data may comprise measured temperature data.

Calibration of the time reading may employ an algorithm which generates appropriate correction coefficients for specified temperatures, and storing the coefficients in a memory associated with the pressure monitoring device. The coefficients may be calculated by measuring drift of the downhole clock relative to real time in a test scenario, for a range of anticipated operating temperatures of the pressure monitoring device. The method may comprise running a compensation algorithm in a microprocessor associated with the memory, which utilises the stored coefficients to correct for changes in the measured, surrounding temperature which the clock is exposed to.

By way of example, a downhole clock exposed to a temperature of 150° C. may experience a drift relative to real time of 1 minute per day, which can be determined in a test scenario. The algorithm may be employed to generate a correction coefficient which calibrates the time so as to correct for this 1 minute discrepancy.

The downhole clock may be provided integrally with the pressure monitoring device, or separately and coupled to the pressure monitoring device. The downhole clock may be provided integrally with the microprocessor. One or more operating function of the microprocessor may be carried out controlled by or with reference to the clock.

The temperature may be monitored by a temperature monitoring device, which device may be provided integrally with the pressure monitoring device and/or clock, or separately and coupled to the pressure monitoring device and/or clock. In either situation, the temperature monitoring device will be positioned sufficiently close to the downhole clock so that the temperature which is monitored is that felt by the clock (or a temperature which is sufficiently close to that felt by the clock so that the calibration is effective). It will be understood that the clock will typically be provided within a housing of the apparatus, and so will be partially shielded from fluids at elevated temperature in the well. The temperature may therefore be monitored within the housing, to account for the shielding effect.

The time span may be a portion of time in the day, and may be a particular time window, say one hour of the day, commencing at the same point each day. In one option, a triggering output may be generated where repetition of the control signal is recognised within that same time span during another day (i.e. during another 24 hour period). For example, where the time span is an hour of the day commencing at a particular time, such as 12.00 hours, the signal would be repeated at 12.00 hours on the next or a succeeding day. In another option, a triggering output may be generated where repetition of the control signal is recognised within that time span of the same day. For example, where the time span is an hour of the day commencing at a particular time, such as 12.00 hours, the signal would be sent once during that hour, and the well then returned to its prior operating condition, and the signal then repeated within that one hour period. The reference to a time span should be interpreted accordingly.

In another aspect of the invention, there is provided apparatus for controlling the operation of a well, the apparatus comprising:

a pressure monitoring device which can be located downhole, and which is operative:

to monitor a characteristic pressure profile of the well during a certain time span; and to respond and generate a triggering output when a significant deviation to the pressure profile is introduced into the well as a control signal to the monitoring device, by comparing two separate pressure profiles within the time span, the device only generating the triggering output when the same pressure profile is monitored twice within the time span;

an actuator which is initiated into operation to control any required operation of the well when the monitoring device responds to the control signal and generates the triggering output;

and in which the apparatus further comprises:

a downhole clock associated with the pressure monitoring device, the device being arranged to monitor the characteristic pressure profile during the specified time span controlled by the clock;

a temperature monitoring device for monitoring the temperature downhole in the region of the clock; and a device for calibrating a time reading of the downhole clock with reference to the monitored temperature, to correct for drift between the clock time and real time resulting from the elevated temperature which the clock is exposed to downhole.

The device for calibrating the time reading of the downhole clock may be arranged to: analyse a time reading output by the clock; assess the drift with real time which has resulted employing the monitored temperature data; and to correct the time reading by an appropriate amount. The device may further be arranged to issue the corrected (or calibrated) time reading on the downhole clock to the pressure monitoring device.

The device for calibrating the time reading of the downhole clock may be arranged to: analyse a time reading output by the clock; assess the drift with real time which has resulted employing the monitored temperature data; and to issue a corrected (or calibrated) time reading to the pressure monitoring device. The device may be further arranged to issue the corrected (or calibrated) time reading directly to the pressure monitoring device.

The calibration may be performed employing a microprocessor, which may be associated with the pressure monitoring device, a temperature monitoring device (for monitoring the temperature) and the clock. Data may be stored in a memory associated with the microprocessor, which data may comprise measured temperature data.

The device for calibrating the time reading of the downhole clock may have a compensation algorithm running in a microprocessor of the apparatus, for applying a stored correction coefficient to the clock time, the coefficient which is applied being appropriate to the temperature which the clock has been exposed to. The algorithm and coefficients may be stored in a memory of the device.

Further features of the apparatus may be derived from or with reference to the method defined above, and/or are defined in the accompanying claims.

BRIEF DESCRIPTION OF THE FIGURES

FIG. 3 is a graph of pressure versus time showing the increase in bottom hole pressure (BHP) and wellhead pressure (WHP) when a well is shut-in.

DESCRIPTION OF PREFERRED EMBODIMENT OF THE INVENTION

Figure 1:
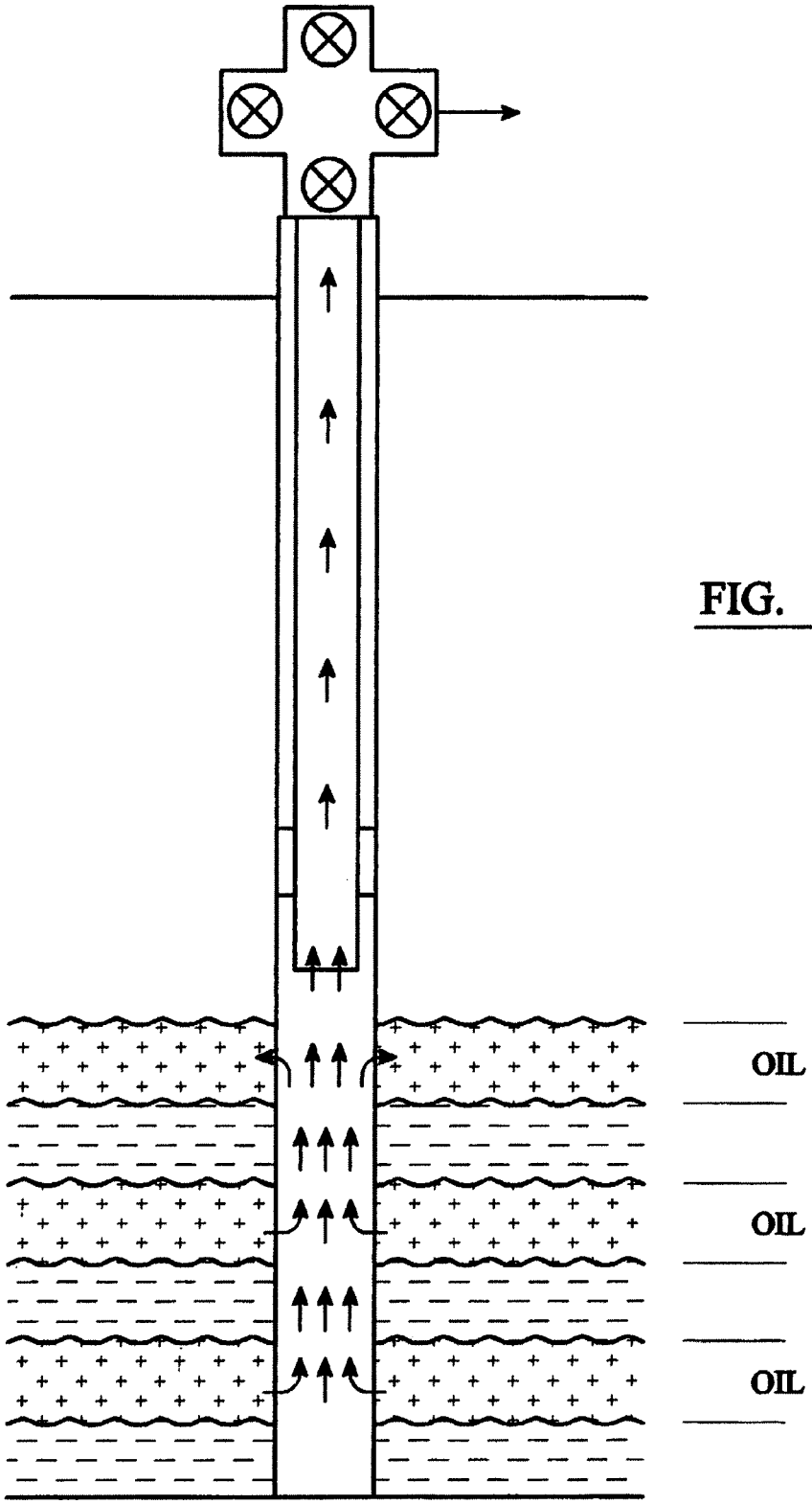
FIG. 1 is a cross-sectional schematic representation of an oil or gas well and associated underground rock formations.
Figure 2:
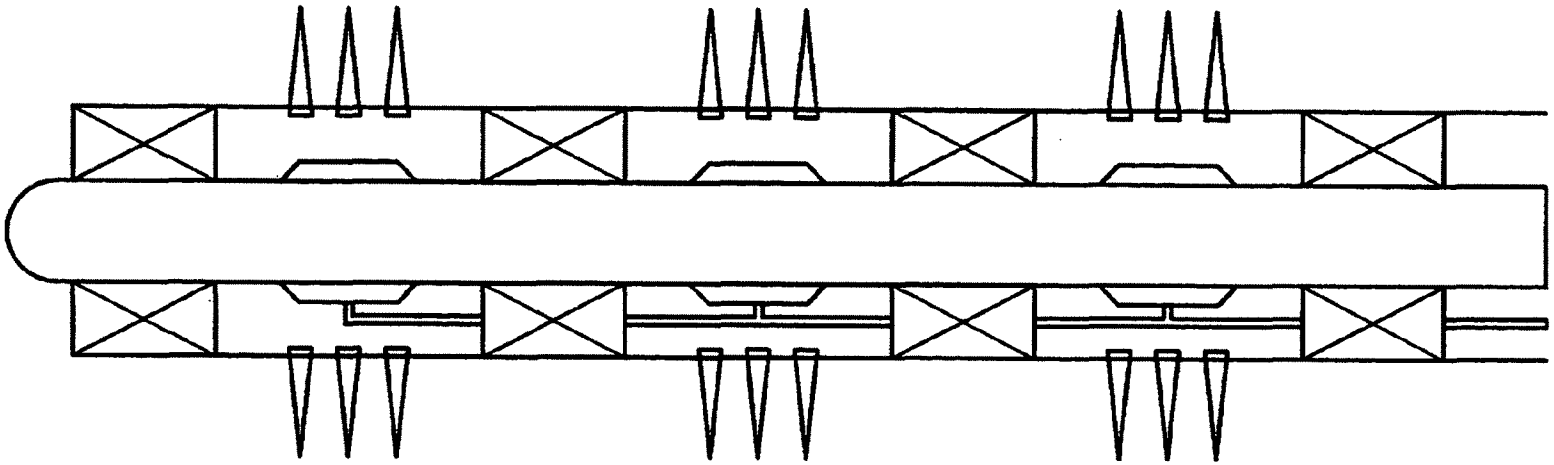
FIG. 2 is a schematic representation of packer assemblies that mechanically separate and isolate zones within a wellbore.
Figure 3:
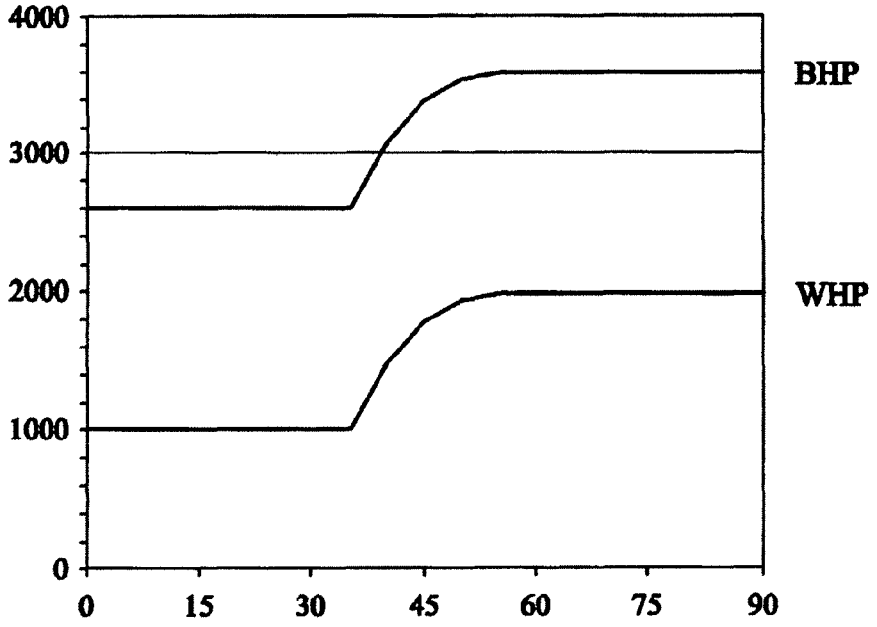
Figure 4:
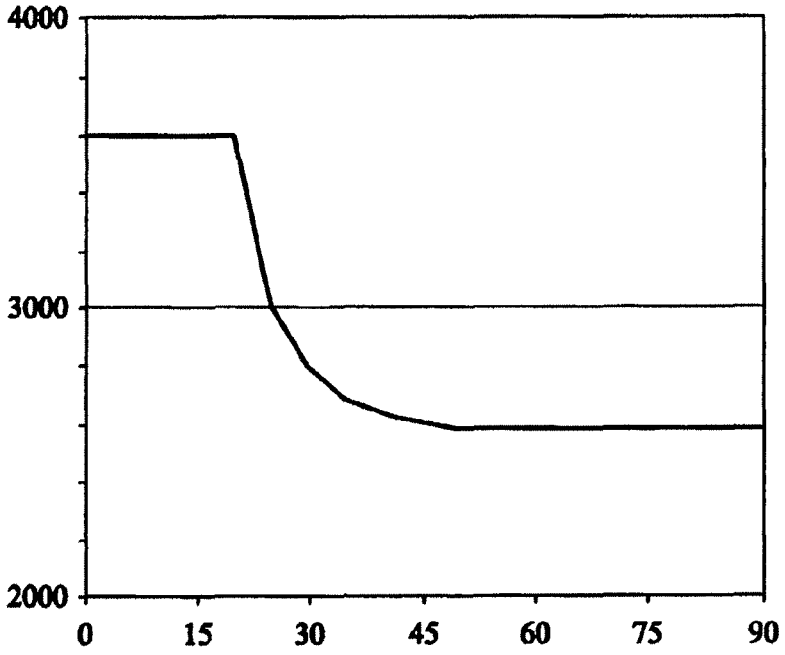
FIG. 4 is a graph of pressure versus time showing the decrease in bottom hole pressure (BHP) when a shut-in well is opened to allow flow.
Figure 5:
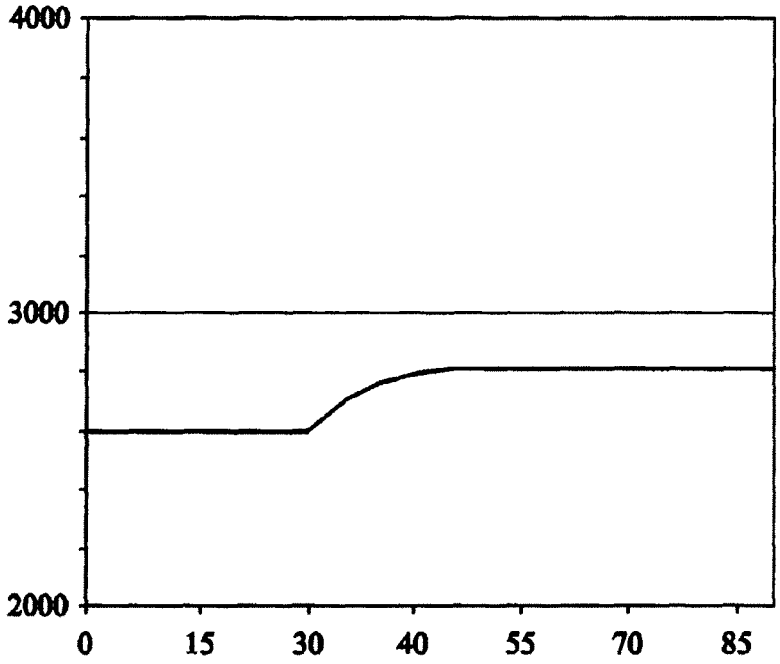
FIG. 5 is a graph of pressure versus time showing the increase in bottom hole pressure (BHP) when a well flowing through a restriction is diverted through a smaller restriction.

A pressure transducer device which is battery powered is housed in a pressure tight container. Also within the housing are batteries, preferably of the long life high density lithium variety, a micro processor and associated P.C.B., a memory portion for storage of the operating programme, a second memory provision for storage of the pressure history from the previous day, a high accuracy quartz oscillator to provide reference for a real time clock and one or more output actuators.

The device will monitor well pressure at a particular time each day for a set period such as one hour. The device will store pressure measurements taken during the period for comparison with other measurements taken in the subsequent period. In the event that the subsequent measurements plus previous measurements conform to a pre programmed profile contained within the tool, an output action will be allowed. This may be operation of an actuator or similar.

The device may be packaged along with a valve type apparatus which may be used to close off the flow from a particular wellbore zone but may also be used for a variety of other purposes. A valve apparatus may be electrically actuated, may be electro-hydraulic or may be purely hydraulic. Simple operating types will generally be of the on/off variety requiring two outputs from the invention. Logic within the device will record the current status of the output actuator(s) and will provide the opposite in recognition of the next signal, ie, opening will follow closure and closure will follow opening. Signalling to the device from surface may entail the same process in both cases.

Operation of a hydraulic device may be accomplished by actuating open a pilot valve for a period of time which allows well pressure to act on a piston. The piston may be housed in a sealed chamber with atmospheric pressure acting on the opposing face. The piston may be linked to the valve sleeve and upon receiving actuating pressure from the well, the piston will stroke and in so doing will close the valve sleeve. Opening the valve device will comprise a similar but reverse acting mechanism. The atmospheric side of the piston will be switched to reference well pressure and the previously well pressure referenced side will be switched to atmospheric pressure. The atmospheric pressure chamber will be required to contain a decent volume as, with multiple use, the pressure within the chamber will increase.

An option to control a multi position device exists whereby the listening hour may be subdivided into, say, three individual twenty minute periods. Recognition of a signal in the first period on both days may correspond to an output from the device which allows ⅓ opening of the downhole valve. Recognition of a signal in the second period within the hour on both days may correspond to ⅔ opening of the device and the third period on both days, full opening.

The scope for a number of increased output options exists where recognition in one of the three twenty minute first day periods coupled with recognition in one of the three twenty minute second day periods (but still within the listening hour) may be recognised. The nine permutations achieved by selecting one of the three available first and one of the three available second day periods within the listening hour may correspond to nine different pre-programmed outputs. Accordingly, a device with nine operational positions may then be signalled and controlled. As before, with a one hour listening period, a maximum number of twenty four of these devices may be positioned in a wellbore (one for each hour) and each function independently of each other. Advantageously, malfunction of one or more will not affect the operation of the remaining devices.

Many other types of well equipment may benefit from use of the signalling method. One example is for use as a safety valve. Normal operation of a well will comprise flowing the well at maximum output without any interruption in order to maximise economic returns from the well. Upon receipt of a platform or facilities alarm, a safety system will be tripped shutting all wells both at surface and at a downhole valve called a safety valve. Should the safety valve be replaced by a device according to the invention, closure may be accomplished by recognition of only one signal. The signal required may be a number of pressure measurements above a pre set pressure threshold such as would be demonstrated when a well is shut in at surface. In this instance, the well would be shut in at surface by the normal facilities system. The well pressure would build up downhole and this feature would be recognised by the device minutes later. The device would then actuate a valve shut off device which would close off the lower portion of the well.

Upon conclusion of the emergency situation, there would be a need to produce the well again and accordingly to open the valve which is closing off the well. In addition to the programmed pressure threshold to close the device, it would additionally have an opening programme. This may compare pressure traces over two hours for example and identify a definite event which may only be a deliberate action from the part of the production operator. This might be pumping into the well and bleeding back at the same point of each hour twice. Recognition of this event will serve to trigger actuation open of the invention.

The preferred embodiments of the invention therefore provide a new and inventive method and apparatus for controlling the operation of a flowing or producing well, whereby a control or actuating signal is transmitted to a downhole tool without any physical link to that tool.

There are many known methods of communicating to downhole tools by providing a signal from the surface. These may be electronic, acoustic, electromagnetic, use dedicated hydraulic control lines or dedicated electrical cables, or may be pressure pulses which are applied to the wellbore, the wellbore annulus (the annular area between the production tubing and the casing) or a mixture of both.

The invention allows a command to be detected, not by application of some external input using one of the above techniques, but by changing the existing dynamics of a flowing well synchronised with time.

Figure 6:
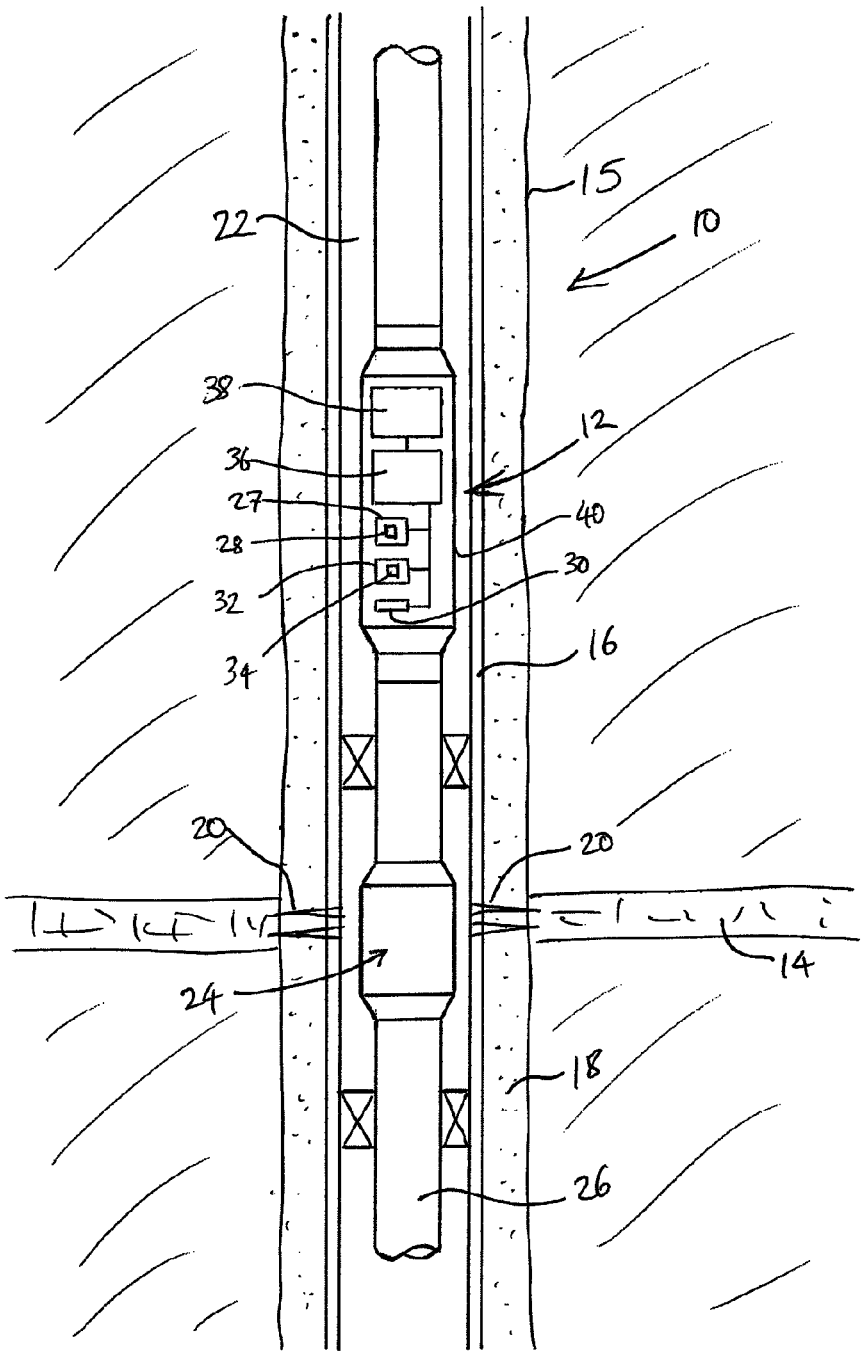
FIG. 6 is a view of a well which is similar to that shown in FIG. 1, illustrating an apparatus for controlling the operation of a well, and steps in a method of controlling the operation of a well, according to an embodiment of the invention.

Turning now to FIG. 6, there is shown a view of a well 10 which is similar to that shown in FIG. 1, illustrating an apparatus 12, and steps in a method of controlling the operation of the well 10, according to an embodiment of the invention. In the illustrated embodiment, the operation which is to be controlled is the flow of well fluids from a producing rock formation 14. To this end, and in a conventional fashion, the well 10 comprises a wellbore 15 which has been drilled from surface, and lined with wellbore-lining tubing in the form of a metal casing 16, which has been cemented at 18. The casing 16 and cement 18 has been perforated at 20, to open fluid communication between an interior 22 of the casing 16 and the producing formation 14. Flow is controlled by means of a sliding sleeve valve 24, which is mounted on production tubing 26 which extends to surface.

The apparatus 12 is operated according to the principles discussed above, to control the operation of an actuator, which in this case is the valve 24, and thus flow of well fluid from the formation 14. Thus a control signal is issued into the well 10 by choking the flow (where the well is already producing, say from a different zone or rock formation), or by pumping or injecting fluid into the well (where the well has been shut-in). The control signal is sent within the monitored time span and then repeated appropriately to cause the apparatus 12 to generate a triggering output. This triggering output is transmitted to the valve 24 by an appropriate means, such as an electrical or hydraulic signal transmitted along a control line (not shown), and actuates the valve open or closed (or partially open/closed), as desired.

In more detail, the apparatus 12 comprises a pressure monitoring device indicated generally by reference numeral 27, and which includes a pressure sensor 28. The device 27 is operative to monitor the characteristic pressure profile of the well 10 during the desired time span and, as discussed above, responds and generates a triggering output for the valve 24 when a significant deviation to the pressure profile is introduced into the well as a control signal to the device. This is achieved by comparing the two separate pressure profiles within the time span. The triggering output is only generated when the same pressure profile is monitored twice within the time span by the pressure monitoring device 27. The valve 24 is initiated into operation to control the required operation of the well when the monitoring device 27 responds to the control signal and generates the triggering output.

The apparatus 12 also comprises a downhole clock, indicated generally by reference numeral 30, which is associated with the pressure monitoring device 27. The clock 30 is of a known electronic type, employing a timing crystal. The device 27 is arranged to monitor the characteristic pressure profile during the specified time span controlled by the clock 30. A temperature monitoring device is provided, indicated generally by reference numeral 32, and includes a temperature sensor 34, which monitors the temperature downhole in the region of the clock 30. The apparatus 12 also comprises a device for calibrating a time reading of the downhole clock with reference to the monitored temperature, which is indicated generally by reference numeral 36 and takes the form of a microprocessor. The microprocessor 36 corrects for drift between the clock 30 time and real time, resulting from the elevated temperature which the clock is exposed to downhole. The clock 30 may be provided integrally with the microprocessor 36, or separately and coupled to the microprocessor. One or more function of the microprocessor 36 will typically be performed or controlled by or with reference to the clock 30.

Calibration is achieved as follows. A time reading output by the clock 30 is analysed by the microprocessor 36. An assessment of the drift with real time which has resulted is then performed, employing the monitored temperature data derived from the temperature monitoring device 32. To this end, the apparatus 12 also comprises an onboard memory 38, which stores the temperature measurements taken by the sensor 34. In a first option, the microprocessor 36 then either corrects the time reading by an appropriate amount, and so corrects (or calibrates) the time reading of the clock 30. The corrected (or calibrated) time reading on the downhole clock 30 is then issued to the pressure monitoring device 27, which employs the corrected time to determine whether it is within the requisite time span. In a second option, the microprocessor 36 issues a corrected (or calibrated) time reading directly to the pressure monitoring device 27. In this scenario, the time reading output by the downhole clock 30 is corrected (or calibrated), but without directly correcting the reading on the clock. The corrected (or calibrated) time reading is issued to the pressure monitoring device 27, which again employs the corrected time to determine whether it is within the requisite time span.

Correction of the time reading according to either method set out in the preceding paragraph may occur on an ongoing basis, or at periodic intervals. In the latter case, the stored, monitored temperature data in the memory 38 facilitates an appropriate calibration. Calibration of the time reading employs an algorithm which generates appropriate correction coefficients for specified temperatures, and involves storing the coefficients in the memory 38. The coefficients are calculated by measuring drift of the downhole clock 30 relative to real time in a test scenario, for a range of anticipated operating temperatures of the pressure monitoring device. A compensation algorithm is run in the microprocessor 36, which utilises the stored coefficients in the memory 38 to correct for changes in the measured, surrounding temperature which the clock 30 is exposed to. More detailed comments on the calibration method are as follows.

The apparatus 12 requires a very accurate low drift real time clock (RTC) 30 to allow it to remain "in sync" with a known and accurate time reference at surface. The RTC 30 is derived from an oscillator circuit that utilises a watch crystal as its frequency deriving component. This type of crystal is cut in such a way to oscillate at a desired frequency, which is generally 32.768 KHz at a temperature of approximately 25° C. (the typical temperature on the surface of a human arm where a watch would be worn). The inherent nature of this type of crystal is such that, either side of this "ideal" temperature, the oscillating frequency will change and follows a parabolic type mathematical function, as shown by the line 44 in FIG. 7, where drift in parts per million (or ppm—a standard measure for clock crystal drift) relative to temperature is shown. As can be seen, the effect of temperature on the crystal increases drastically as the temperature increases. In terms of time error, whereas at 25° C. there is no (or insubstantial) error, a loss in time of close to one minute per day can be expected at 150° C. FIG. 8 shows this correlation and, as can be seen, the line 44 and a line 46 respectively representing the crystal characteristic and the corresponding time drift are superimposed.

Figure 7:
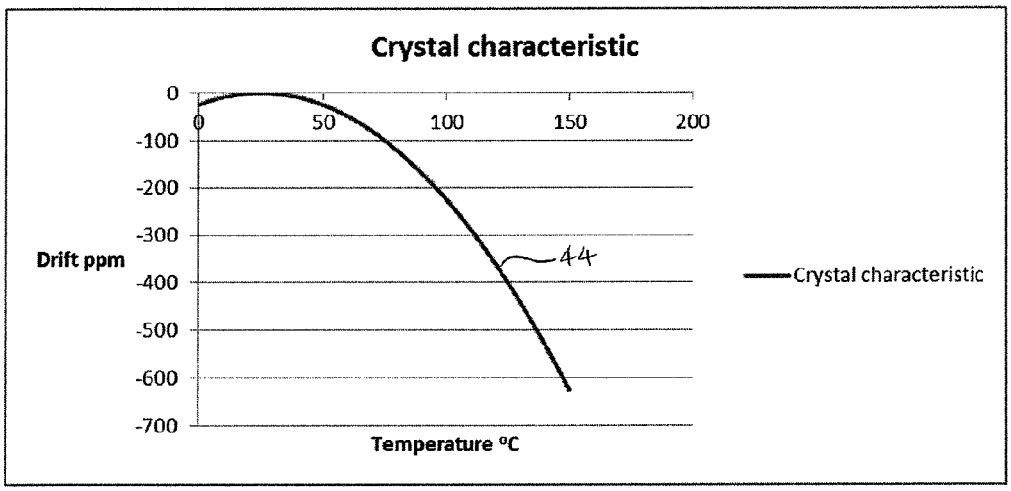
FIG. 7 is a graph of crystal oscillation drift against temperature for a timing crystal of a clock of the apparatus of FIG. 6.
Figure 8:
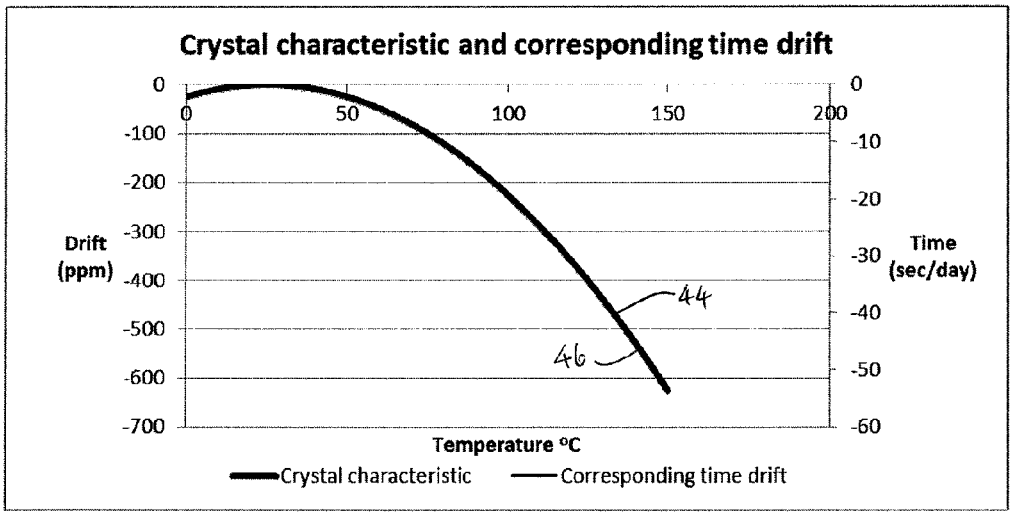
FIG. 8 is a graph showing the timing crystal drift against temperature and the resultant time drift.
Figure 9:
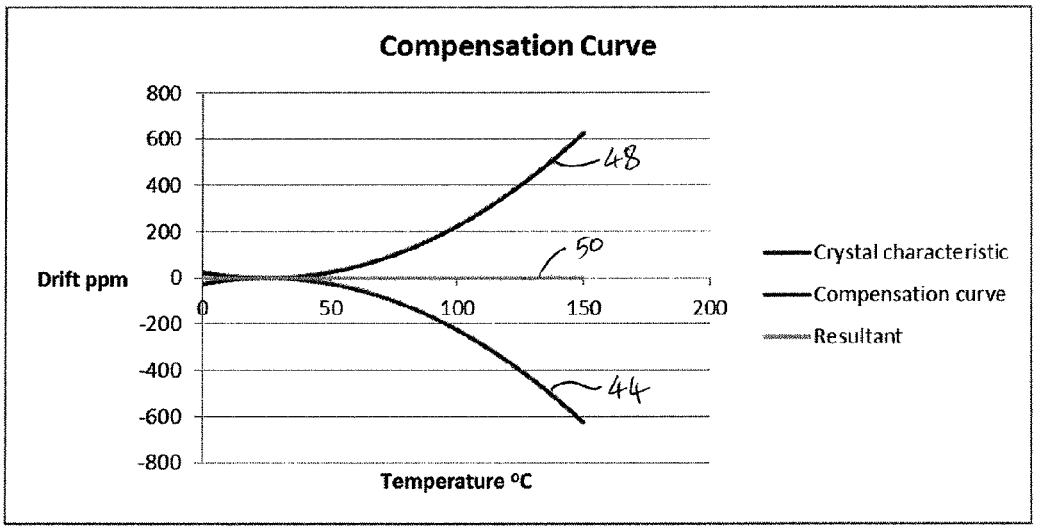
FIG. 9 is a graph showing the timing crystal drift against temperature, an inverse compensation curve derived from the crystal drift curve and the resultant drift against temperature.

To compensate for this "drift" a corresponding mathematical function that is the inverse of FIG. 7 is required, which will result in a net difference of zero (or as close to zero as can practically be achieved). This is shown in FIG. 9, where the crystal characteristic is shown again by the line 44, the compensation curve by the inverse line 48, and the resultant by the line 50. As each crystal and circuit is slightly different due to component tolerances, the calibration method generates coefficients that can be applied in the algorithm run on the apparatus 12 (in the microprocessor 36) as the surrounding environment temperature changes. Accordingly, knowledge of the required correction coefficients for particular temperatures, derived from suitable testing, enables derivation of the algorithm to be run in the microprocessor necessary to produce the compensation curve 48. The apparatus 12 can thus be calibrated by means of measuring the natural drift of the crystal across the calibrated temperature range in a test scenario in the laboratory environment. From this the calibration coefficients can be calculated and stored on the microprocessor 36. Typically the corrected error will yield better than a ±1 second a day error.

From the above, it will be evident that appropriate programming of the apparatus 12, in particular the microprocessor 36, will enable calibration of the clock 30 to take account of the increased temperature that the clock is exposed to downhole. In the example given above, a downhole clock exposed to a typical downhole temperature of 150° C. experiences a drift relative to real time of ~1 minute per day, as can be seen from the line 46 in FIG. 8. The algorithm which is derived from the data is employed to generate a correction coefficient which calibrates the time so as to correct for this 1 minute discrepancy.

It will be evident that the skilled person can derive a suitable algorithm from the data represented in the graphs of FIGS. 7 to 9. Accordingly, one possible algorithm may be generated based upon the time drift vs. temperature information in FIGS. 7 to 9. Further, the data may vary depending on the particular timing crystal employed; usable information may be obtained in a controlled laboratory setting.

In the illustrated embodiment, the temperature monitoring device 32 is provided as an integral part of the apparatus 12, and the temperature monitoring device 32, pressure monitoring 27 device and clock 30 are all coupled to microprocessor 36. The temperature monitoring device 32, in particular the sensor 34, is positioned sufficiently close to the downhole clock 30 so that the temperature which is monitored is that felt by the clock (or a temperature which is sufficiently close to that felt by the clock so that the calibration is effective). The components, in particular the clock 30, are provided within a housing 40 of the apparatus 12, and so will be partially shielded from fluids at elevated temperature in the well. The temperature may therefore be monitored within the housing 40, to account for the shielding effect.

Certain general comments on the invention are as follows.

"Demand" activation according to the principles described above revolves around sensing a non-preprogramed pressure signal that is repeated on two separate occasions but in the same time span (which may, for example, be at the same time of day on different days). The time at which the apparatus of the invention scans for a signal, and then the repetition, is preprogramed prior to the deployment of the apparatus. For this reason a RTC (Real Time Clock—the clock 30) has been incorporated in the design of the electronics in the apparatus. Its role is to keep the time of day, and it should stay synchronised with a surface clock so that an operator knows when the apparatus will be in its scanning phase, and can then send the control signal at the correct time.

It is known that crystal frequency of the clock alters with respect to temperature. Due to this characteristic, any time base derived from a crystal (in the clock) will lose or gain time as its surrounding temperature changes, typically in a parabolic nature. As the temperature increases so does the rate of drift, leading to large errors on a day-to-day basis. This feature is not desirable due to the reliance of knowing that both the tool and surface times are in synchronisation.

To overcome this problem, the applicants have developed a calibration system that measures the drift across the temperature range of the apparatus. A software algorithm generates appropriate correction coefficients that are uploaded to the apparatus, where it in turn has a compensation algorithm that utilises the stored coefficients to correct for changes in surrounding temperature. For the 150° C. drift of 1 minute per day discussed above, the apparatus of the invention has been found to be able to reduce this to around 1 second per day across the whole temperature range.

In another aspect, the invention provides a method of signalling from surface to a remote device disposed in a producing oil or gas borehole comprising:

surface means for restricting flow;

surface time indication means synchronised with:

downhole electronics module comprising: real time monitoring means; pressure sensing means for sensing pressure changes; temporary memory means to store recent pressure history; multi processor means to control and schedule operation of the device, to match separate profiles of present and recent pressure history, to execute activation programme upon detection of matching profiles and to store defined logic/profile parameters;

battery means to provide electrical power to the device;

actuatory means to execute the received command;

whereby the dynamic properties of a flowing well are altered in order to provide a recognisable signal, detectable by the downhole device.

In a further aspect, the invention provides a method for signalling from surface to a remote device disposed in a producing oil or gas borehole comprising:

surface means for restricting flow, surface time indication means synchronised with:

downhole electronics module comprising real time monitoring means, pressure sensing means for sensing pressure changes, temporary memory means to store recent pressure history, multi processor means to control and schedule operation of the device, to match separate profiles of present and recent pressure history, to execute activation programme upon detection of matching profiles and to store defined logic/profile parameters, battery means to provide electrical power to the device, actuator means to execute the received command, whereby the dynamic properties of a flowing well are altered in order to provide a recognisable signal, detectable by the downhole device.

In another aspect, the invention provides a method and apparatus for controlling the operation of a flowing or producing well utilising:

a downhole located pressure monitoring device which is operative to monitor a characteristic pressure profile of the flowing well, and to respond when a significant deviation to the pressure profile is introduced into the well as a control signal to the monitoring device; and an actuator which is initiated into operation to control any required operation of the well when the monitoring device responds to the control signal.

Therefore, in a method and apparatus according to the aspect defined in the preceding paragraph, a significant improvement is provided whereby two separate pressure profiles are compared.

Conveniently, in a method and apparatus according to the invention for controlling the operation of a flowing or producing well, there is provision of means for utilising a non-predetermined signature.

If desired, the actuator is arranged to operate a flow control valve, or may be arranged to initiate an explosive charge if required.

A clock (not real time) may be arranged to compare events at predetermined intervals e.g. every three, five or seven hours, to correct for any possibility of "drift" with a real time clock which otherwise would result in the control signal being sent when the clock was not "listening".

In a particularly preferred arrangement according to the invention, a self-learning capability is provided, by storage of any pressure profile for comparison with a later pressure profile for a finite time period.

In another aspect of the invention, there is provided a method for signalling from surface to a remote device disposed in a producing oil or gas borehole, for control of the production of fluids or gas from a discrete area of the producing formation allowing communication whilst producing fluids substantially uninterrupted comprising:

surface means for restricting flow, surface time indication means synchronised with:

downhole electronics module comprising, time monitoring means to compare present readings from pressure sensing means with recent readings from pressure sensing means, pressure sensing means for sensing pressure changes, temporary memory means to store recent pressure history, multi processor means to control and schedule operation of the device to match separate profiles of present and recent pressure history, to execute activation programme upon detection of matching profiles and to store defined logic/profile parameters, battery means to provide electrical power to the device and actuator, valve means to allow opening or closure of flow from the discrete area of the formation rock into the wellbore, one or more actuator means to operate the valve, packer means to provide pressure isolation of a discrete area of the formation rock from other areas.

The method may be arranged to transmit a signal to a device located in a wellbore.

In another aspect of the invention, there is provided a method for controlling the operation of a flowing or producing well utilising:

a downhole located pressure monitoring device which is operative to monitor a characteristic pressure profile of the flowing well, and to respond when a significant deviation to the pressure profile is introduced into the well as a control signal to the monitoring device (by comparing two separate pressure profiles); and an actuator which is initiated into operation to control any required operation of the well when the monitoring device responds to the control signal.

The method may utilise a non-predetermined signature.

In another aspect of the invention, there is provided apparatus for controlling the operation of a flowing or producing well and comprising:

a downhole located pressure monitoring device which is operative to monitor a characteristic pressure profile (pressure fingerprint) of the flowing well, and to respond when a significant deviation to the pressure profile is introduced into the well as a control signal to the monitoring device; and an actuator which is initiated into operation to control any required operation of the well when the monitoring device responds to the control signal.

The actuator may comprise a flow control valve.

The invention claimed is:

1. A method for controlling the operation of a well, the method comprising the steps of:

locating a pressure monitoring device downhole;

arranging the pressure monitoring device so that it is operative:

to monitor a characteristic pressure profile of the well during a certain time span; and to respond and generate a triggering output when a significant deviation to the pressure profile is introduced into the well as a control signal to the monitoring device, by comparing two separate pressure profiles within the time span, the device only generating the triggering output when the same pressure profile is monitored twice within the time span;

arranging an actuator so that it is initiated into operation to control any required operation of the well when the monitoring device responds to the control signal and generates the triggering output;

in which the method comprises the further steps of:

arranging the pressure monitoring device to monitor the characteristic pressure profile during the specified time span controlled by a downhole clock associated with the device;

monitoring the temperature downhole in the region of the clock; and calibrating a time reading of the downhole clock with reference to the monitored temperature, to correct for drift between the clock time and real time resulting from the elevated temperature which the clock is exposed to downhole.

2. A method as claimed in claim 1, in which the method is for controlling the operation of a flowing or producing well, in which the pressure monitoring device is operative to monitor a characteristic pressure profile of the flowing well.

3. A method as claimed in claim 1, in which the method is for controlling the operation of a well which is not flowing or in which fluid is pumped or injected into the well.

4. A method as claimed in claim 1, in which the step of calibrating the time reading of the downhole clock comprises:

analysing a time reading output by the clock;

assessing the drift with real time which has resulted employing the monitored temperature data; and correcting the time reading by an appropriate amount.

5. A method as claimed in claim 4, involving correcting the time reading of the clock, and then issuing the corrected time reading on the downhole clock to the pressure monitoring device.

6. A method as claimed in claim 4, in which correction of the time reading occurs on an ongoing basis.

7. A method as claimed in claim 4, in which correction of the time reading occurs at periodic intervals, and in which the method comprises storing monitored temperature history so that an appropriate calibration can be made.

8. A method as claimed in claim 1, in which the step of calibrating the time reading of the downhole clock comprises:

analysing a time reading output by the clock;

assessing the drift with real time which has resulted employing the monitored temperature data; and issuing a corrected time reading to the pressure monitoring device.

9. A method as claimed in claim 8, involving correcting the time reading output by the downhole clock and issuing the corrected time reading to the pressure monitoring device.

10. A method as claimed in claim 8, in which correction of the time reading occurs on an ongoing basis.

11. A method as claimed in claim 8, in which correction of the time reading occurs at periodic intervals, and in which the method comprises storing monitored temperature history so that an appropriate calibration can be made.

12. A method as claimed in claim 1, in which calibration of the time reading employs an algorithm which generates appropriate correction coefficients for specified temperatures, and the method comprises storing the coefficients in a memory associated with the pressure monitoring device.

13. A method as claimed in claim 12, in which the coefficients are calculated by measuring drift of the downhole clock relative to real time in a test scenario, for a range of anticipated operating temperatures of the pressure monitoring device.

14. A method as claimed in claim 12, comprising running a compensation algorithm in a microprocessor associated with the memory, which utilises the stored coefficients to correct for changes in the measured, surrounding temperature which the clock is exposed to.

15. Apparatus for controlling the operation of a well, the apparatus comprising:

a pressure monitoring device which can be located downhole, and which is operative:

to monitor a characteristic pressure profile of the well during a certain time span; and to respond and generate a triggering output when a significant deviation to the pressure profile is introduced into the well as a control signal to the monitoring device, by comparing two separate pressure profiles within the time span, the device only generating the triggering output when the same pressure profile is monitored twice within the time span;

an actuator which is initiated into operation to control any required operation of the well when the monitoring device responds to the control signal and generates the triggering output;

and in which the apparatus further comprises:

a downhole clock associated with the pressure monitoring device, the device being arranged to monitor the characteristic pressure profile during the specified time span controlled by the clock;

a temperature monitoring device for monitoring the temperature downhole in the region of the clock; and a device for calibrating a time reading of the downhole clock with reference to the monitored temperature, to correct for drift between the clock time and real time resulting from the elevated temperature which the clock is exposed to downhole.

16. Apparatus as claimed in claim 15, in which the device for calibrating the time reading of the downhole clock is arranged to:

analyse a time reading output by the clock;

assess the drift with real time which has resulted employing the monitored temperature data; and to correct the time reading by an appropriate amount.

17. Apparatus as claimed in claim 16, in which the device is further arranged to issue the corrected time reading on the downhole clock to the pressure monitoring device.

18. Apparatus as claimed in claim 15, in which the device for calibrating the time reading of the downhole clock is arranged to:

analyse a time reading output by the clock;

assess the drift with real time which has resulted employing the monitored temperature data; and to issue a corrected time reading to the pressure monitoring device.

19. Apparatus as claimed in claim 18, in which the device is further arranged to issue the corrected time reading directly to the pressure monitoring device.

* * * * *